US010947657B2

(12) United States Patent
Xu et al.

(10) Patent No.: US 10,947,657 B2
(45) Date of Patent: Mar. 16, 2021

(54) STEAM GENERATING DEVICE FOR WASHING MACHINE AND WASHING MACHINE

(71) Applicant: QINGDAO HAIER DRUM WASHING MACHINE CO., LTD., Shandong (CN)

(72) Inventors: Sheng Xu, Shandong (CN); Yanfen Lv, Shandong (CN); Zhiqiang Zhao, Shandong (CN)

(73) Assignee: Qingdao Haier Drum Washing Machine Co., Ltd., Shandong (CN)

( * ) Notice: Subject to any disclaimer, the term of this patent is extended or adjusted under 35 U.S.C. 154(b) by 450 days.

(21) Appl. No.: 15/748,068

(22) PCT Filed: Aug. 26, 2016

(86) PCT No.: PCT/CN2016/096866
§ 371 (c)(1),
(2) Date: Jan. 26, 2018

(87) PCT Pub. No.: WO2017/016528
PCT Pub. Date: Feb. 2, 2017

(65) Prior Publication Data

US 2018/0216276 A1 Aug. 2, 2018

(30) Foreign Application Priority Data

Jul. 27, 2015 (CN) ..... 201510447466.0

(51) Int. Cl.

| | |
|---|---|
| ***D06F 39/00*** | (2020.01) |
| ***D06F 39/04*** | (2006.01) |
| ***D06F 39/14*** | (2006.01) |
| *D06F 37/26* | (2006.01) |

(52) U.S. Cl.
CPC ..... *D06F 39/008* (2013.01); *D06F 39/04* (2013.01); *D06F 39/14* (2013.01); *D06F 37/267* (2013.01); *D06F 2204/04* (2013.01)

(58) Field of Classification Search
CPC ..... D06F 39/008; D06F 39/04; D06F 39/14; D06F 39/087; D06F 2204/04; D06F 37/267; D06F 75/10; D06F 75/20
(Continued)

(56) References Cited

U.S. PATENT DOCUMENTS 1,420,759 A * 6/1922 Sawicki ..... H05B 3/78 392/441
1,499,605 A * 7/1924 Brown ..... D06F 39/04 68/139
(Continued)

FOREIGN PATENT DOCUMENTS

CN 1948601 A * 4/2007
CN 1948601 A 4/2007
(Continued)

OTHER PUBLICATIONS

Piao Shuokui, "Steam generating device of laundry machine" Apr. 2007, CN 1948601A—Machine Translation (Year: 2007).*
(Continued)

*Primary Examiner* — David G Cormier
*Assistant Examiner* — Thomas Bucci
(74) *Attorney, Agent, or Firm* — David B. Tingey; Bryant J. Keller; Kirton McConkie

(57) ABSTRACT

A steam generating device for a washing machine and a washing machine are disclosed. The steam generating device includes a heating pipe connected to a heating control unit. A steam heating chamber is further arranged above the heating pipe. A cover plate component for facilitating escaping of steam and supplementation of cold water is arranged
(Continued)

above the steam heating chamber. In the steam generating device, the steam heating chamber is arranged around the hot water pipe arranged on the bottom portion of a rear outer drum and the cover plate component is provided for engagement, such that continuous steam is generated in a washing process.

4 Claims, 4 Drawing Sheets

(58) Field of Classification Search
USPC ..... 68/5 C, 5 R, 12.22, 15, 12.18, 23 R; 8/149.3, 158
See application file for complete search history.

(56) References Cited

U.S. PATENT DOCUMENTS 5,335,523 A * 8/1994 Anastase ..... D06F 39/04 134/105
6,553,594 B2 * 4/2003 Broker ..... D06F 33/00 8/158
7,406,737 B2 * 8/2008 Yang ..... D06F 39/008 8/158
7,760,993 B2 * 7/2010 You ..... D06F 39/008 392/494
7,913,523 B2 * 3/2011 Lyu ..... D06F 39/04 68/15
7,930,838 B2 * 4/2011 Bae ..... D06F 58/02 34/597
7,941,884 B2 * 5/2011 Block ..... D06F 39/04 8/149.3
7,987,541 B2 * 8/2011 Oh ..... D06F 35/006 8/159
8,074,475 B2 * 12/2011 Lyu ..... D06F 39/04 68/15
2004/0083770 A1 * 5/2004 Lyu ..... D06F 37/26 68/15
2004/0187527 A1 * 9/2004 Kim ..... D06F 39/008 68/5 C
2004/0244432 A1 * 12/2004 Kim ..... D06F 39/008 68/5 C
2005/0034249 A1 * 2/2005 Oh ..... D06F 39/008 8/159
2005/0092035 A1 * 5/2005 Shin ..... D06F 39/02 68/275
2005/0132503 A1 * 6/2005 Yang ..... D06F 35/006 8/149.3
2005/0132504 A1 * 6/2005 Yang ..... D06F 39/008 8/159
2005/0132757 A1 * 6/2005 Lee ..... D06F 58/26 68/15
2005/0144735 A1 * 7/2005 Yang ..... D06F 39/008 8/149.3
2005/0223503 A1 * 10/2005 Hong ..... D06F 39/008 8/158
2005/0262644 A1 * 12/2005 Oak ..... D06F 35/003 8/158
2005/0279141 A1 * 12/2005 Kim ..... D06F 39/04 68/12.22
2006/0005581 A1 * 1/2006 Banba ..... D06F 25/00 68/5 R
2006/0117596 A1 * 6/2006 Kim ..... D06F 33/00 34/607
2006/0191077 A1 * 8/2006 Oh ..... D06F 33/00 8/158
2006/0277690 A1 * 12/2006 Pyo ..... D06F 25/00 8/149.2
2007/0028398 A1 * 2/2007 Kwon ..... D06F 37/26 8/158
2007/0101773 A1 * 5/2007 Park ..... D06F 39/008 68/5 C
2007/0199353 A1 * 8/2007 Woo ..... F22B 1/284 68/5 R
2007/0240458 A1 * 10/2007 Kim ..... F22B 1/284 68/5 R
2008/0006063 A1 * 1/2008 Ahn ..... D06F 39/008 68/5 R
2008/0011023 A1 * 1/2008 Kim ..... D06F 39/04 68/15
2008/0115381 A1 * 5/2008 Bae ..... D06F 58/203 34/60
2008/0115740 A1 * 5/2008 You ..... D06F 75/20 122/235.14
2008/0134445 A1 * 6/2008 Cho ..... D06F 39/04 8/149.1
2008/0141734 A1 * 6/2008 Son ..... D06F 58/203 68/5 C
2008/0168805 A1 * 7/2008 Kim ..... F22B 1/284 68/5 C
2008/0196267 A1 * 8/2008 Park ..... D06F 39/04 34/443
2008/0201865 A1 * 8/2008 Lee ..... D06F 58/203 8/149.1
2008/0201866 A1 * 8/2008 Lee ..... D06F 39/008 8/149.3
2008/0250573 A1 * 10/2008 Lee ..... D06F 34/28 8/149.1
2008/0263783 A1 * 10/2008 Pyo ..... D06F 43/02 8/149.3
2008/0276659 A1 * 11/2008 Bae ..... D06F 39/008 68/5 C
2008/0282750 A1 * 11/2008 Yang ..... D06F 39/008 68/5 C
2009/0056035 A1 * 3/2009 Herkle ..... D06F 39/008 8/149.3
2009/0056036 A1 * 3/2009 Herkle ..... D06F 39/008 8/149.3
2009/0077755 A1 * 3/2009 Park ..... D06F 35/006 8/137
2009/0126420 A1 * 5/2009 Tsunemine ..... D06F 39/08 68/5 C
2009/0139550 A1 * 6/2009 Lim ..... A47L 15/0002 134/107
2009/0272155 A1 * 11/2009 Jeong ..... D06F 39/04 68/5 C
2010/0142935 A1 * 6/2010 Kim ..... F22B 1/284 392/394
2010/0263137 A1 * 10/2010 Block ..... D06F 39/04 8/159
2010/0288743 A1 * 11/2010 Kim ..... D06F 39/008 219/201
2011/0154866 A1 * 6/2011 Lee ..... D06F 39/008 68/5 C
2011/0197638 A1 * 8/2011 Murrell ..... D06F 39/04 68/5 C
2013/0185873 A1 * 7/2013 Bomar ..... D06F 39/08 8/137
2013/0198970 A1 * 8/2013 Doh ..... D06F 58/02 8/137
2014/0053615 A1 * 2/2014 Fukuda ..... D06F 39/008 68/5 C
2014/0075683 A1 * 3/2014 Kim ..... D06F 25/00 8/137
2014/0208522 A1 * 7/2014 Oh ..... D06F 39/008 8/137
2014/0208523 A1 * 7/2014 Kim ..... D06F 39/04 8/137
2015/0211169 A1 * 7/2015 Park ..... D06F 87/00 68/5 C
2016/0090680 A1 * 3/2016 Lyu ..... F22B 1/288 68/5 C
2019/0010656 A1 * 1/2019 Kim ..... A47L 15/4234

FOREIGN PATENT DOCUMENTS

CN 101191612 A 6/2008
CN 101290111 A 10/2008

(56) References Cited

FOREIGN PATENT DOCUMENTS

| | | | |
|---|---|---|---|
| CN | 101932765 | A | 12/2010 |
| EP | 1914337 | A1 | 4/2008 |
| JP | 2014004060 | A | 1/2014 |
| WO | 2006129912 | A1 | 7/2006 |
| WO | 2011/101235 | A1 | 8/2011 |

OTHER PUBLICATIONS

European Search Report dated Apr. 4, 2019 from the European Patent Office for Application No. 16829893.3-1018 / 3450611 corresponding to PCT/CN2016096866 filed Aug. 26, 2016.
International Search Report dated Nov. 15, 2016 from International Patent Application No. PCT/CN2016/096866 filed Aug. 26, 2016.

* cited by examiner

STEAM GENERATING DEVICE FOR WASHING MACHINE AND WASHING MACHINE

TECHNICAL FIELD

The present application relates to the technical field of domestic appliances, and for example, relates to a steam generating device for a washing machine and a washing machine.

BACKGROUND

Washing machines are cleaning electric appliances used to wash clothes through a mechanical effect generated by electric energy. The washing machines are classified into two categories, i.e., household washing machines and collective washing machines, according to rated washing capacities. China specifies that the washing machines with the washing capacities below 6 kg belong to the household washing machines. The household washing machine is mainly composed of a box body, a washing and dewatering drum (a washing drum and a dewatering drum may be separately provided), a transmission and control system and the like, and some household washing machines may be provided with a heating apparatus.

The washing machines in a relevant technology are already widely used in families, and a steam washing function is gradually applied to the washing machines with the diversification of user needs for the washing machine function. Steam washing integrates a new steam washing mode based on traditional water washing. In a washing process, steam is uniformly sprayed to an inner drum and clothes so as to easily eliminate deep dirt such as oil stain, sweat stain and the like. Washing with high-temperature steam can effectively kill bacteria attached to the clothes. When the users wash the clothes of children, the users do not need to add disinfectant, thereby avoiding a possibility of hurting skin by residual chemicals.

In addition, this soft steam spray not only naturally stretches the clothes and makes the clothes more smooth, but also can easily eliminate odors on the clothes. This steam refreshing function rejuvenates clothing contaminated with deep hotpot flavor or smoke flavor and eliminates the trouble of water washing. Furthermore, the softer washing mode greatly reduces abrasion damage to the clothes, so the users can feel free to wash high-grade clothes such as woollen sweaters and the like.

Compared with water, the steam can gently penetrate into the clothes to remove wrinkles of the clothes and can also remove undesirable odors and inhibit the bacteria. Therefore, the steam washing is praised as a technology of "SPA" without pollution in the industry. This steam technology is directly applied to washing, making it possible that the clothes really enjoy the "SPA". However, the steam washing function in the relevant technology is realized through many methods which need to add an individual apparatus, causing high cost and space waste.

SUMMARY

The present application proposes a steam generating device for a washing machine and a washing machine. By installing a steam heating chamber around a hot water pipe arranged on a bottom of a rear outer drum and cooperating with a cover plate component, continuous steam is generated in a washing process, space occupation is reduced, the cost of the steam device is reduced, and an assembly process is simplified. The steam generating device has high safety, stability and reliability.

The present disclosure further proposes a washing machine including the steam generating device. The steam generating device does not need to be installed individually, occupies no external space, saves cost and is more convenient and safe.

An embodiment of the present disclosure provides a steam generating device for a washing machine, including: a heating pipe. A steam heating chamber is arranged above the heating pipe, and a cover plate component for facilitating escaping of steam and supplementation of cold water is arranged above the steam heating chamber.

Optionally, the steam heating chamber is kept sealed except top and side openings; slots are formed respectively at top portions of both side walls of the steam heating chamber; the cover plate component is inserted on a top portion of the steam heating chamber through the slots and the steam heating chamber is kept in a closed state.

Optionally, the cover plate component includes a side plate and a top plate, which are connected to each other; and the side plate and the top plate are respectively adapted with a top portion and a side portion of the steam heating chamber.

Optionally, the top plate is further provided with a plurality of steam discharging ports for discharging heated steam; and the side plate is further provided with a plurality of water flow exchange ports for introducing an external water flow with negative pressure.

Optionally, the steam discharging ports are hollow conical structures; and the water flow exchange ports are formed at a bottom portion of the side plate, and the plurality of water flow exchange ports are arranged in a shape of teeth.

Optionally, at least one end of the steam heating chamber near the slots is provided with a limiting apparatus for preventing the cover plate component from slipping.

Optionally, the heating control unit includes a heating control circuit and a temperature sensor; the heating control circuit is connected to the heating pipe and the temperature sensor; the heating control circuit is intermittent heating for preventing dry-fire of the heating pipe; and an operating process of the intermittent heating is $M=A_{heating}+nB_{circle}+C_{stop}+k_{Bcircle}$, wherein $A_{heating}$ represents starting heating for A seconds, $B_{circle}$ represents one intermittent heating cycle ($X_{heating}+Y_{intermittent}$), n and k are constants, $C_{stop}$ is heating stop time, and M is less than or equal to $T_{min}$, wherein T is a constant.

Optionally, the heating control unit includes a heating control circuit, a control piece, and a level gauge arranged in the steam heating chamber for preventing dry-fire of the heating pipe; the control piece is connected with the heating control circuit, the level gauge and the heating pipe respectively; the level gauge transmits a liquid level value measured in real time to the control piece; when the liquid level value is lower than a preset safety value, the heating control unit stops heating to prevent dry-fire of the heating pipe; and when the liquid level value is greater than the preset safety value, the heating control unit controls the heating pipe to continue to operate.

Optionally, the device further includes a hot washing heating pipe arranged outside the steam heating chamber.

An embodiment of the present disclosure provides a washing machine, including the steam generating device for the washing machine.

Embodiments of the present disclosure provide a steam generating device for a washing machine. A hot water pipe is arranged on a bottom of a rear outer drum of the washing machine for maximum utilization; the steam heating chamber is arranged around the steam generating device; and the cover plate component closes the steam heating chamber, continuous steam is generated in a washing process, and the hot water pipe is prevented from dry-fire. Meanwhile, the cost of the steam device is reduced, space occupation is reduced and an assembly process is simplified. The steam generating device has high safety, stability and reliability, simplifies a hot water control process of the washing machine, and is more quick and convenient.

BRIEF DESCRIPTION OF DRAWINGS

One or more embodiments are exemplarily described through corresponding figures in drawings. These exemplary descriptions do not form a limitation to embodiments. Elements having the same reference numerals in the drawings represent similar elements. Unless otherwise specified, the figures in the drawings do not form a proportional limit.

In the drawings.

1. front outer drum; 2. rear outer drum; 3. cover plate component; 31. slot; 32. steam discharging port; 33. water flow exchange port; 34. top plate; 35. side plate; 4. heating pipe; 5. level gauge; 6. heating control unit; 321. hollow conical structure; 322. air outlet hole; and 7. steam heating chamber.

DETAILED DESCRIPTION

The technical solution of the present disclosure will be described below in combination with drawings through specific embodiments. Features in embodiments can be mutually combined in case of no conflict.

Embodiment 1

Figure 1:
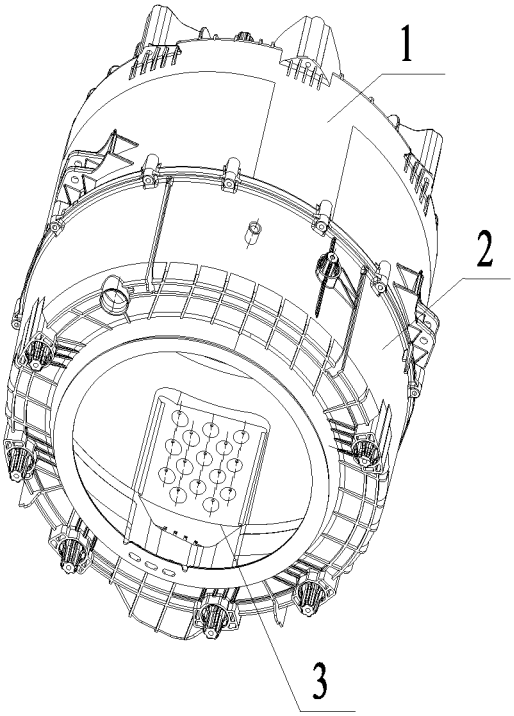
FIG. 1 is a structural schematic diagram 1 illustrating a steam generating device for a washing machine provided in an embodiment of the present disclosure.
Figure 2:
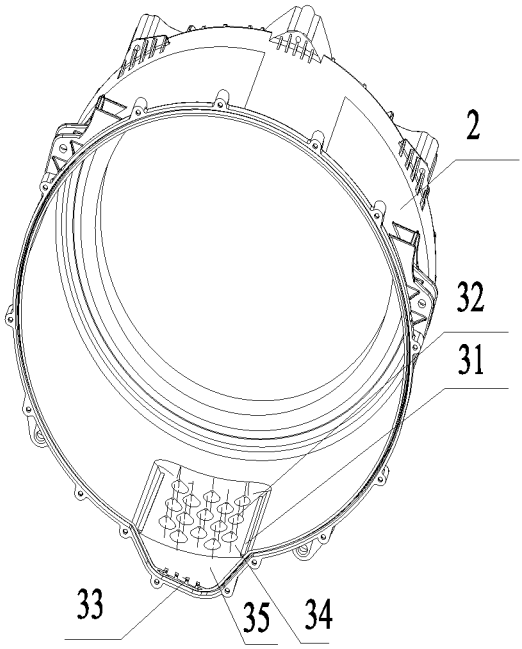
FIG. 2 is a structural schematic diagram 2 illustrating a steam generating device for a washing machine provided in an embodiment of the present disclosure.
Figure 3:
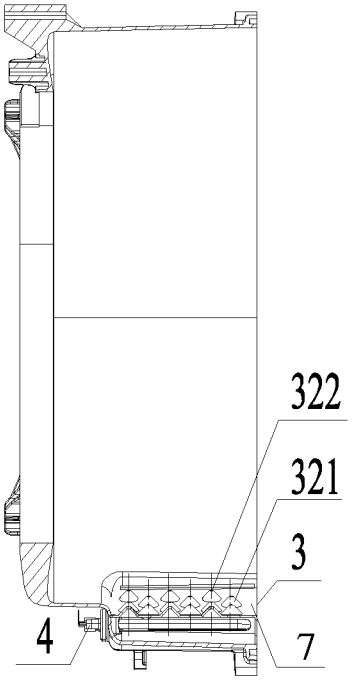
FIG. 3 is a side view illustrating a steam generating device for a washing machine provided in an embodiment of the present disclosure.

As shown in FIG. 1 to FIG. 3, embodiments of the present disclosure provide a steam generating device for a washing machine. The steam generating device includes a heating pipe 4. A steam heating chamber 7 is arranged above the heating pipe 4, and a cover plate component 3 for facilitating overflow of steam and supplementation of cold water is arranged above the steam heating chamber 7. The cover plate component 3 together with the steam heating chamber 7 forms a cavity. The cavity exchanges gas and water with the outside only through the cover plate component. Optionally, the heating pipe 4 is an anti-dry-fire heating pipe.

The heating pipe 4 generates steam in the cavity. The steam escapes from the cover plate component 3. Meanwhile, negative pressure is formed in the cavity. External cold water enters the cavity through the cover plate component 3, and then is heated by the heating pipe 4 to generate steam, the steam escapes; and operation is repeated like this.

An outer drum of the washing machine is generally formed by combining a front outer drum 1 and a rear outer drum 2. Therefore, after the outer drum is fixed, a position and a direction of the cover plate component 3 are also defined accordingly, so assembly of the cover plate component 3 is more convenient and quick.

Optionally, except top and side openings, the entire steam heating chamber 7 is sealed to prevent the water from flowing out from the outer drum. Slots 31 matched with the cover plate component 3 are formed respectively at tops of both side walls of the steam heating chamber 7. The cover plate component 3 is inserted on the top of the steam heating chamber 7 through the slots 31 and the steam heating chamber 7 exchanges gas and water with the outside only through the cover plate component 3 so as to keep the steam heating 7 in a closed state.

Figure 4:
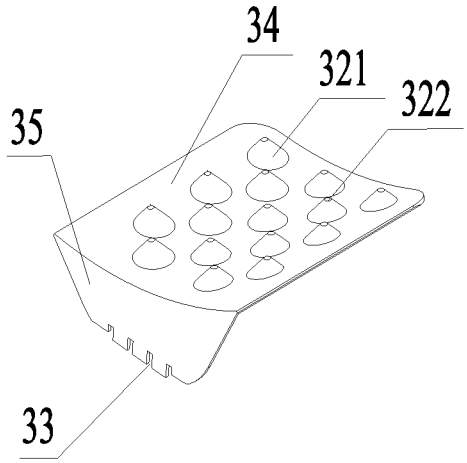
FIG. 4 is a structural schematic diagram illustrating a cover plate component provided in an embodiment of the present disclosure.

Optionally, as shown in FIG. 4, the cover plate component 3 includes a side plate 35 and a top plate 34 which are connected; and the side plate 35 and the top plate 34 are respectively adapted with a top and a side portion of the steam heating chamber 7. Moreover, a closed cavity which exchanges gas and water with outside through the side plate 35 and the top plate 34 only is formed jointly by the steam heating chamber 7, the side plate 35 and the top plate 34. Optionally, the side plate 35 and the top plate 34 are vertically connected, and the side plate 35 and the top plate 34 may be an integral structure.

Optionally, a plurality of steam discharging ports 32 for discharging heated steam are also formed in the top plate 34, and a plurality of water flow exchange ports 33 for introducing an external water flow by using negative pressure are also formed in the side plate 35. The steam generated through heating of the heating pipe 4 in the closed cavity is discharged from the steam discharging ports 32 at a top of the closed cavity.

Since the water in the closed cavity is adapted with the heating power of the heating pipe 4, a large amount of steam is rapidly generated in the closed cavity and escapes, so the pressure intensity in the closed cavity is less than the pressure intensity of the external water. Then the water outside the side plate 35 enters the closed cavity from the water flow exchange ports 33 under the effect of the negative pressure, and then is heated and vaporized by the heating pipe 4 into steam which escapes.

Because of the existence of the closed cavity, when the water in the closed cavity is heated by the heating pipe 4, heat exchange between the closed cavity and an exterior of the closed cavity is greatly less than heat of the heating pipe 4 for heating the water body in the closed cavity, ensuring that the water in the closed cavity is rapidly heated and then reaches a boiling point. Optionally, the water in the closed cavity is 300-500 ml, and a time for heating to the boiling point is 1-2 min.

Optionally, the plurality of steam discharging ports 32 are formed in the top plate 34. The steam discharging ports 32 are hollow conical structures 321. Air outlet holes 322 are formed at tops of the hollow conical structures 321. The hollow conical structures 321 and structures of the air outlet holes 322 at the top of the closed cavity not only facilitate the discharge of steam but also prevent the large amount of heat loss in the closed cavity. Optionally, the hollow conical structures 321 and the top plate 34 are integrally formed structures.

Optionally, the water flow exchange ports 33 are formed at a bottom of the side plate 35, and the plurality of water flow exchange ports 33 are arranged in a shape of teeth. The water flow exchange ports 33 are at the lowest position in the closed cavity so as to slow down the speed of the water flowing from outside the side plate 35 into the closed cavity and keep the water in the closed cavity heated rapidly.

Optionally, the heating control unit 6 includes a heating control circuit and a temperature sensor. The heating control circuit is connected with the heating pipe 4 and the temperature sensor. The heating control circuit performs intermittent heating for preventing dry-fire of the heating pipe. An operating process of the intermittent heating is $M=A_{heating}+nB_{circle}+C_{stop}+kB_{circle}$ where $A_{heating}$ represents a duration for starting heating A, $B_{circle}$ represents one intermittent heating cycle ($Y_{intermittent}+X_{heating}$), n and k are constants, $C_{stop}$ is heating stop time, and M is less than or equal to Tmin, wherein T is a constant and min refers to minute. During operation, $A_{heating}$ is 1 min; $B_{circle}=(Y_{intermittent}+X_{heatin})$=intermittent 5 s+heating 20 s; $C_{stop}$ is 5 min; a value range of n is 7-15; a value range of k is 7-15; and M is less than or equal to 20 min.

Optionally, a limiting apparatus for preventing the cover plate component 3 from slipping is arranged on at least one end of the steam heating chamber 7 near the slots 31. After the cover plate component 3 is inserted into the slots 31, the cover plate component 3 is firmly fixed to the steam heating chamber 7 by the limiting apparatus so as to prevent the connection position between the cover component 3 and the steam heating chamber 7 from changing when a large amount of steam exists in the closed cavity and avoid affecting the operation of the entire steam generating apparatus for the washing machine. Embodiments of the present disclosure further provide a washing machine, including the steam generating device for the washing machine.

Optionally, the steam generating device further includes: a hot washing heating pipe arranged outside the steam heating chamber 7. Configuration of the hot washing heating pipe is used to rapidly improve the temperature of the water in the drum to achieve a purpose of hot water washing. When a user selects heating washing, the hot washing heating pipe is operated and the heating pipe 4 is in a non-operation state; and when the user selects steam washing, the heating pipe 4 is operated and the hot washing heating pipe is in a non-operation state.

Optionally, the user may select normal washing, heating washing, steam washing and steam heating washing. When the user starts the normal washing, the heating pipe 4 is in the non-operation state, and the washing machine performs normal washing, drainage, dewatering, rinsing and drying procedures.

When the user starts steam washing, water is firstly injected into the drum; and after the water is injected to a preset water quantity, washing is started and steam heating is performed during the washing process. Since the steam is continuously generated in the steam heating chamber 7, an interior of the steam heating chamber 7 is in a mixed state of water and steam. If the heating pipe 4 cannot be completely immersed in the water, the heating pipe 4 may be damaged due to dry-fire. Therefore, the control circuit connected with the heating pipe 4 is required to control the heating pipe 4 to perform intermittent heating, so as to prevent the heating pipe 4 from being damaged. An intermittent heating mode is M=Aheating+nBcircle+Cstop+kBcircle. During specific operation, Aheating is 1 min; Bcircle=(Yintermittent+Xheating)=intermittent 5 s+heating 20 s; Cstop is 5 min; a value range of n is 7-15; a value range of k is 7-15; and M is less than or equal to 20 min. Namely, heating is performed first for 1 min; then intermittent heating is performed for 3-5 min; next, heating is stopped for 5 min; then, intermittent heating is performed for 3-5 min; and the entire process of generating the steam is not greater than 20 min. At the end of the washing process, normal drainage, dewatering and rinsing procedures are performed.

When the user chooses to start heating washing, water is firstly injected into the drum; and after the water is injected to a preset water level, the heating control circuit controls the hot washing heating pipe to intermittently heat the water in the drum. Optionally, when a water temperature in the drum, measured by the temperature sensor, is lower than a preset heating temperature, the heating control circuit controls the heating pipe to perform intermittent heating using $B_{circle}$ as an intermittent heating cycle ($Y_{intermittent}+X_{heating}$), wherein X and Y are constants and values of X and Y are adjustable with different operating environments and requirements. Optionally, the heating control circuit controls the hot washing heating pipe to operate in a cycle of operating for 10 s and intermitting for 5 s. When the temperature transmitted in real time by the temperature sensor is greater than a preset heating temperature, the heating control circuit controls the hot washing heating pipe to stop heating, and the drainage, rinsing and dewatering are performed after the end of the washing process.

When the user selects steam heating washing, the washing procedure is first started; and after water is injected to a preset water level, a steam heating procedure in the steam washing is started, namely the heating pipe 4 performs the steam heating procedure. The intermittent heating mode is $M=A_{heating}+nB_{circle}+C_{stop}+kB_{circle}$. During operation, $A_{heating}$ is 1 min; $B_{circle}=(Y_{intermittent}+X_{heating})$=intermittent 5 s+heating 20 s; $C_{stop}$ is 5 min; a value range of n is 7-15; a value range of k is 7-15; and M is less than or equal to 20 min. Namely, heating is performed first for 1 min; then intermittent heating is performed for 3-5 min; next, heating is stopped for 5 min; then, intermittent heating is performed for 3-5 min; and the entire process of generating the steam is not greater than 20 min.

After the steam heating procedure is completed, the heating procedure of heating washing is operated. When the water temperature in the drum, measured by the temperature sensor, is lower than the preset heating temperature, the heating control circuit controls the hot washing heating pipe to perform intermittent heating using $B_{circle}$ as an intermittent heating cycle ($Y_{intermittent}+X_{heating}$), wherein X and Y are constants and values of X and Y are adjustable with different operating environments and requirements. Optionally, the heating control circuit controls the hot washing heating pipe to run in a cycle of operating for 10 s and intermitting for 5 s; and when the temperature transmitted in real time by the temperature sensor is greater than a preset heating temperature, the heating control circuit controls the hot washing heating pipe to stop heating, and the drainage, rinsing and dewatering procedures are performed after the end of the washing process.

In embodiments of the present disclosure, the hot water pipe arranged on the bottom of the rear outer drum of the washing machine is fully used. The steam heating chamber 7 is arranged around the hot water pipe, the steam heating chamber 7 is closed by the cover plate component, and hence continuous steam is generated in the washing process, the hot water pipe is protected against dry-fire, the cost of the steam apparatus is reduced, and space occupation is reduced. The assembly process is simplified. The steam generating device has high safety, stability and reliability.

Figure 5:
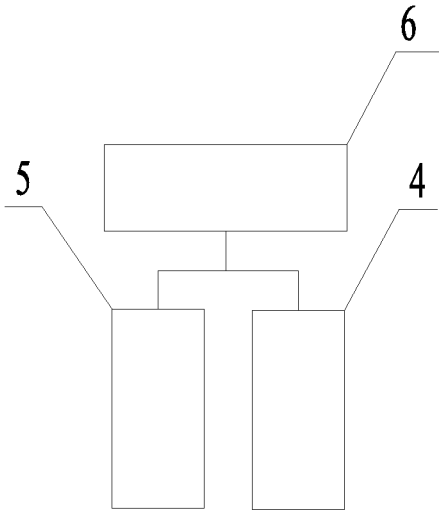
FIG. 5 is a block diagram illustrating a heating control unit provided in an embodiment of the present disclosure.

FIG. 5 is a block diagram illustrating a heating control unit in a steam generating device for a washing machine provided in embodiments of the present disclosure. Unlike embodiment 1, since the steam is continuously generated in the cavity, the interior of the cavity is in a mixed state of water and steam. If the heating pipe 4 cannot be completely immersed in the water, the heating pipe 4 may be damaged due to dry-fire. Therefore, optionally, the steam heating chamber 7 is further provided with a level gauge 5 for preventing dry-fire of the heating pipe 4. When the water level in the cavity is lower than a preset water level, heating is stopped; and after the steam is discharged, the negative pressure in the cavity is increased so that the external water body enters the cavity, and after the water level reaches a safety water level heating is restarted.

Embodiment 2

Optionally, as shown in FIG. 5, the steam generating device further includes a heating control unit 6. The heating control unit 6 is respectively connected with the level gauge 5 and the heating pipe 4. The level gauge 5 transmits the liquid level value measured in real time to the heating control unit. When the liquid level value is lower than the preset safety value, the heating control unit 6 stops heating in order to prevent dry-fire of the heating pipe 4. The water outside the side plate 35 continues to enter the closed cavity through the water flow exchange ports 33, and the heating control unit 6 controls the heating pipe 4 to continue to operate when the real time liquid level value is greater than or equal to the preset safety value. When the liquid level value is greater than the preset safety value, the heating control unit 6 controls the heating pipe 4 to continue to operate.

In embodiments of the present application, the hot water pipe arranged on the bottom of the rear outer drum of the washing machine is fully used, the steam heating chamber 7 is arranged around the hot water pipe, the steam heating chamber 7 is closed by and the cover plate component, continuous steam is generated in the washing process, the hot water pipe is protected against dry-fire, as a result, the cost of the steam device is reduced, and space occupation is reduced. The assembly process is simplified. The steam generating device has high safety, stability and reliability. Meanwhile, configuration of the level gauge further simplifies the hot water control process of the washing machine and realizes rapidness and convenience.

Embodiments of the present disclosure also provide a washing machine, including the steam generating device for the washing machine in any one of embodiments.

The above washing machine includes the steam generating device for the washing machine in any one of embodiments, including corresponding structures and beneficial effects in the steam generating device for the washing machine. Technical details not detailed in the present embodiment can be found in the steam generating device for the washing machine provided in embodiments of the present disclosure.

Industrial Applicability

Through adoption of the above technical solution in embodiments of the present disclosure, the hot water pipe arranged on the bottom of the rear outer drum of the washing machine is fully used, the steam heating chamber is arranged around the hot water pipe, the steam heating chamber is closed by the cover plate component and the level gauge, continuous steam is generated in the washing process, the hot water pipe is protected against dry-fire, the cost of the steam device is also reduced, and space occupation is reduced. The assembly process is simplified. The steam generating device has high safety, stability and reliability.

What is claimed is:

1. A steam generating device for a washing machine, comprising: a heating control unit, a heating pipe connected to the heating control unit, a level gauge arranged in a steam heating chamber for preventing dry-fire of the heating pipe, the steam heating chamber being arranged around the heating pipe, and a cover plate component for facilitating escaping of steam and supplementation of cold water and configured to cover a side opening and a top opening of the steam heating chamber;

wherein, the heating control unit is connected with the level gauge and the heating pipe respectively;

wherein the level gauge is configured to transmit a liquid level value measured in real time to the heating control unit;

wherein the heating control unit is configured to: when the liquid level value is lower than a preset safety value, stop heating to prevent dry-fire of the heating pipe; and when the liquid level value is greater than the preset safety value, control the heating pipe to continue to operate;

wherein the heating pipe is arranged on a bottom of a rear outer drum of the washing machine, the steam heating chamber is formed partially on an inner surface of the rear outer drum, formed by part of the inner surface of the rear outer drum recessing outwards, and kept sealed except the top opening and the side opening;

wherein slots are formed respectively at top portions of two side walls of the steam heating chamber;

wherein the cover plate component is inserted on a top portion of the steam heating chamber through the slots and the steam heating chamber is kept in a closed state;

wherein the cover plate component comprises a side plate and a top plate, which are connected to each other;

wherein the side plate and the top plate are respectively fitted with the side opening and the top opening of the steam heating chamber;

wherein when the cover plate component is inserted into the top portion of the steam heating chamber, the top plate is arranged on the inner surface of the rear outer drum; and wherein the top plate is further provided with a plurality of steam discharging ports for discharging heated steam, and the side plate is further provided with a plurality of water flow exchange ports for introducing an external water flow into the steam heating chamber via negative pressure.

2. The steam generating device for a washing machine according to claim 1, wherein the steam discharging ports comprise hollow conical structures; and the water flow exchange ports are formed at a bottom portion of the side plate, and the plurality of water flow exchange ports are arranged in a shape of teeth with a preset interval.

3. A washing machine, comprising: a steam generating device, wherein the steam generating device comprises a heating control unit, a heating pipe connected to the heating control unit, a level gauge arranged in a steam heating chamber for preventing dry-fire of the heating pipe, the steam heating chamber being arranged around the heating pipe and a cover plate component for facilitating escaping of steam and supplementation of cold water and configured to cover a side opening and a top opening of the steam heating chamber;

wherein the heating control unit is connected with the level gauge and the heating pipe respectively;

wherein the level gauge is configured to transmit a liquid level value measured in real time to the heating control unit;

wherein the heating control unit is configured to: when the liquid level value is lower than a preset safety value, stop heating to prevent dry-fire of the heating pipe; and when the liquid level value is greater than the preset safety value, control the heating pipe to continue to operate;

wherein the heating pipe is arranged on a bottom of a rear outer drum of the washing machine, the steam heating chamber is formed partially on an inner surface of the rear outer drum, formed by a part of the inner surface of the rear outer drum recessing outwards, and kept sealed except the top opening and the side opening;

wherein slots are formed respectively at top portions of two side walls of the steam heating chamber;

wherein the cover plate component is inserted on a top portion of the steam heating chamber through the slots and the steam heating chamber is kept in a closed state;

wherein the cover plate component comprises a side plate and a top plate, which are connected to each other;

wherein the side plate and the top plate are respectively fitted with the side opening and the top opening of the steam heating chamber;

wherein when the cover plate component is inserted into the top portion of the steam heating chamber, the top plate is arranged on the inner surface of the rear outer drum; and wherein the top plate is further provided with a plurality of steam discharging ports for discharging heated steam, the side plate is further provided with a plurality of water flow exchange ports for introducing an external water flow into the steam heating chamber via negative pressure.

4. The washing machine according to claim 3, wherein the steam discharging ports comprise hollow conical structures; and the water flow exchange ports are formed at a bottom portion of the side plate, and the plurality of water flow exchange ports are arranged in a shape of teeth with a preset interval.

* * * * *